US009193055B2

(12) United States Patent
Lim et al.

(10) Patent No.: US 9,193,055 B2
(45) Date of Patent: Nov. 24, 2015

(54) ELECTRONIC CLUTCH FOR POWER TOOL

(71) Applicant: Black & Decker Inc., Newark, DE (US)

(72) Inventors: Jongsoo Lim, Timonium, MD (US); Brian Sterling, Sykesville, MD (US); Paul White, Ellicott City, MD (US); Russell Hester, Odenton, MD (US)

(73) Assignee: BLACK & DECKER INC., Newark, DE (US)

( * ) Notice: Subject to any disclaimer, the term of this patent is extended or adjusted under 35 U.S.C. 154(b) by 420 days.

(21) Appl. No.: 13/798,210

(22) Filed: Mar. 13, 2013

(65) Prior Publication Data

US 2013/0269961 A1 Oct. 17, 2013

Related U.S. Application Data

(60) Provisional application No. 61/623,739, filed on Apr. 13, 2012.

(51) Int. Cl.
*B25F 5/00* (2006.01)
*B25B 23/147* (2006.01)

(52) U.S. Cl.
CPC ..... *B25F 5/001* (2013.01); *B25B 23/147* (2013.01)

(58) Field of Classification Search
CPC ..... B25B 23/147; B25F 5/00; G05B 15/02
USPC ..... 173/1, 2, 4, 11, 176, 217
See application file for complete search history.

(56) References Cited

U.S. PATENT DOCUMENTS

| | | | | |
|---|---|---|---|---|
| 3,281,100 | A | | 10/1966 | Uemura et al. |
| 4,056,762 | A | | 11/1977 | Schadlich |
| 4,088,197 | A | | 5/1978 | Roll et al. |
| 4,200,829 | A | | 4/1980 | Pohl |
| 4,249,117 | A | | 2/1981 | Leukhardt et al. |
| 4,265,320 | A | | 5/1981 | Tanaka et al. |
| 4,267,914 | A | | 5/1981 | Saar |
| 4,307,325 | A | * | 12/1981 | Saar ..... 388/809 |
| 4,317,176 | A | | 2/1982 | Saar et al. |
| 4,418,765 | A | | 12/1983 | Mori et al. |
| 4,426,588 | A | | 1/1984 | Weilenmann |
| 4,463,293 | A | | 7/1984 | Hornung et al. |

(Continued)

FOREIGN PATENT DOCUMENTS

| | | |
|---|---|---|
| DE | 4328599 | 3/1994 |
| DE | 102008033866 | 1/2010 |

(Continued)

*Primary Examiner* — Nathaniel Chukwurah
(74) *Attorney, Agent, or Firm* — Harness, Dickey & Pierce, P.L.C.

(57) ABSTRACT

A method is presented for controlling operation of a power tool having an electric motor drivably coupled to an output spindle. The method includes: receiving an input indicative of a clutch setting for an electronic clutch, where the clutch setting is selectable from a plurality of driver modes; setting the value of a maximum current threshold in accordance with the selected one of the plurality of driver modes; determining rotational speed of the electric motor; determining an amount of current being delivered to the electric motor; comparing the amount of current being delivered to the electric motor to the maximum current threshold; and interrupting transmission of torque to the output spindle when the amount of current being delivered to the electric motor exceeds the maximum current threshold and the rotational speed of the electric motor is decreasing.

20 Claims, 8 Drawing Sheets

(56) References Cited

U.S. PATENT DOCUMENTS

| | | | | |
|---|---|---|---|---|
| 4,485,682 | A | 12/1984 | Stroezel et al. | |
| 4,487,270 | A | 12/1984 | Huber | |
| 4,503,370 | A | 3/1985 | Cuneo | |
| 4,671,364 | A | 6/1987 | Fink et al. | |
| 4,823,057 | A | 4/1989 | Eley | |
| 4,831,364 | A | 5/1989 | Shinohara et al. | |
| 5,154,242 | A | 10/1992 | Soshin et al. | |
| 5,277,261 | A | 1/1994 | Sakoh | |
| 5,353,882 | A | 10/1994 | Inoue et al. | |
| 5,361,852 | A | 11/1994 | Inoue et al. | |
| 5,401,124 | A | 3/1995 | Hettich | |
| 5,410,229 | A * | 4/1995 | Sebastian et al. | 318/434 |
| 5,563,482 | A | 10/1996 | Shaw et al. | |
| 5,631,823 | A | 5/1997 | Layer et al. | |
| 5,650,573 | A | 7/1997 | Bruns et al. | |
| 5,704,435 | A | 1/1998 | Meyer et al. | |
| 5,738,177 | A | 4/1998 | Schell et al. | |
| 5,754,019 | A | 5/1998 | Walz | |
| 5,868,208 | A | 2/1999 | Peisert et al. | |
| 5,890,405 | A | 4/1999 | Becker | |
| 5,893,685 | A | 4/1999 | Olson et al. | |
| 5,996,707 | A | 12/1999 | Thome et al. | |
| 6,167,606 | B1 | 1/2001 | Mueller et al. | |
| 6,371,218 | B1 | 4/2002 | Amano et al. | |
| 6,415,875 | B1 | 7/2002 | Meixner et al. | |
| 6,516,896 | B1 | 2/2003 | Bookshar et al. | |
| 6,536,536 | B1 | 3/2003 | Gass et al. | |
| 6,584,841 | B1 | 7/2003 | Ichinose et al. | |
| 6,598,684 | B2 | 7/2003 | Watanabe | |
| 6,687,567 | B2 | 2/2004 | Watanabe | |
| 6,700,341 | B2 | 3/2004 | Schaer et al. | |
| 6,843,327 | B2 | 1/2005 | Meixner et al. | |
| 6,923,268 | B2 | 8/2005 | Totsu | |
| 6,945,337 | B2 | 9/2005 | Kawai et al. | |
| 6,968,908 | B2 | 11/2005 | Tokunaga et al. | |
| 6,978,846 | B2 | 12/2005 | Kawai et al. | |
| 6,997,083 | B1 | 2/2006 | Olszewski | |
| 7,055,620 | B2 | 6/2006 | Nadig et al. | |
| 7,071,645 | B2 | 7/2006 | Hahn et al. | |
| 7,155,986 | B2 | 1/2007 | Kawai et al. | |
| 7,234,536 | B2 | 6/2007 | Scholl et al. | |
| 7,253,940 | B2 | 8/2007 | Fitzmaurice et al. | |
| 7,306,046 | B2 | 12/2007 | Meixner et al. | |
| 7,350,595 | B2 | 4/2008 | Sato et al. | |
| 7,395,871 | B2 | 7/2008 | Carrier et al. | |
| 7,400,106 | B2 | 7/2008 | DeCicco et al. | |
| 7,410,006 | B2 | 8/2008 | Zhang et al. | |
| 7,419,013 | B2 | 9/2008 | Sainomoto et al. | |
| 7,422,582 | B2 | 9/2008 | Malackowski et al. | |
| 7,428,934 | B2 | 9/2008 | Arimura | |
| 7,467,700 | B2 | 12/2008 | Greese et al. | |
| 7,487,845 | B2 | 2/2009 | Carrier et al. | |
| 7,506,694 | B2 | 3/2009 | Stirm et al. | |
| 7,521,892 | B2 | 4/2009 | Funabashi et al. | |
| 7,551,411 | B2 | 6/2009 | Woods et al. | |
| 7,552,781 | B2 | 6/2009 | Zhang et al. | |
| 7,556,103 | B2 | 7/2009 | Matsunaga | |
| 7,591,195 | B2 | 9/2009 | Puzio | |
| 7,602,137 | B2 * | 10/2009 | Du et al. | 318/771 |
| 7,677,844 | B2 | 3/2010 | Schell et al. | |
| 7,681,659 | B2 | 3/2010 | Zhang et al. | |
| 7,726,412 | B2 | 6/2010 | Matsunaga | |
| 7,730,963 | B2 | 6/2010 | Carrier et al. | |
| 7,730,964 | B2 | 6/2010 | Simm et al. | |
| 7,795,829 | B2 | 9/2010 | Seiler et al. | |
| 7,938,194 | B2 | 5/2011 | Carrier et al. | |
| 8,074,731 | B2 | 12/2011 | Iwata et al. | |
| 2002/0033267 | A1 | 3/2002 | Schweizer et al. | |
| 2002/0060082 | A1 | 5/2002 | Watanabe | |
| 2002/0097018 | A1 | 7/2002 | Nagata et al. | |
| 2003/0121677 | A1 | 7/2003 | Watanabe et al. | |
| 2003/0149508 | A1 | 8/2003 | Watanabe | |
| 2004/0003930 | A1 | 1/2004 | Meixner et al. | |
| 2004/0207351 | A1 | 10/2004 | Hahn et al. | |
| 2005/0045353 | A1 | 3/2005 | Kawai et al. | |
| 2005/0109519 | A1 | 5/2005 | Kawai et al. | |
| 2005/0109520 | A1 | 5/2005 | Kawai et al. | |
| 2005/0247459 | A1 | 11/2005 | Voigt et al. | |
| 2005/0263303 | A1 | 12/2005 | Shimizu et al. | |
| 2005/0263304 | A1 | 12/2005 | Sainomoto et al. | |
| 2005/0263305 | A1 | 12/2005 | Shimizu et al. | |
| 2006/0032648 | A1 | 2/2006 | Scholl et al. | |
| 2006/0185869 | A1 | 8/2006 | Arimura | |
| 2006/0237205 | A1 | 10/2006 | Sia et al. | |
| 2007/0210733 | A1 | 9/2007 | Du et al. | |
| 2007/0250098 | A1 | 10/2007 | Malackowski et al. | |
| 2008/0230245 | A1 | 9/2008 | Matsunaga | |
| 2008/0289839 | A1 | 11/2008 | Hricko et al. | |
| 2009/0308628 | A1 | 12/2009 | Totsu | |
| 2010/0065293 | A1 | 3/2010 | Lohr | |
| 2010/0147545 | A1 | 6/2010 | Hirt et al. | |
| 2010/0304913 | A1 | 12/2010 | Su | |
| 2010/0307782 | A1 | 12/2010 | Iwata et al. | |
| 2011/0000688 | A1 | 1/2011 | Iwata | |
| 2011/0030981 | A1 | 2/2011 | Totsu | |
| 2011/0034283 | A1 | 2/2011 | Tsai et al. | |

FOREIGN PATENT DOCUMENTS

| | | |
|---|---|---|
| EP | 0486843 | 5/1992 |
| GB | 2405822 | 3/2005 |
| JP | 6312857 | 5/1988 |
| JP | 63290182 | 11/1988 |
| JP | 1127281 | 5/1989 |
| JP | 1301027 | 12/1989 |
| JP | 1321177 | 12/1989 |
| JP | 2145227 | 6/1990 |
| JP | 2107279 | 8/1990 |
| JP | 2206382 | 8/1990 |
| JP | 2238897 | 9/1990 |
| JP | 3202236 | 9/1991 |
| JP | 3279691 | 12/1991 |
| JP | 4035806 | 2/1992 |
| JP | 2586757 | 11/1992 |
| JP | 5138418 | 6/1993 |
| JP | 7052060 | 2/1995 |
| JP | 3663638 | 1/1996 |
| JP | 8001536 | 1/1996 |
| JP | 10234130 | 9/1998 |
| JP | 11138459 | 5/1999 |
| JP | 2000094206 | 4/2000 |
| JP | 2001062745 | 3/2001 |
| JP | 2001062746 | 3/2001 |
| JP | 2002233967 | 8/2002 |
| JP | 2003021170 | 1/2003 |
| JP | 2003049869 | 2/2003 |
| JP | 2003181139 | 7/2003 |
| JP | 2004066413 | 3/2004 |
| JP | 2006026850 | 2/2006 |
| JP | 2008182832 | 8/2008 |
| JP | 2008220077 | 9/2008 |
| JP | 2010012585 | 1/2010 |
| WO | WO88/06508 | 9/1988 |
| WO | WO02/075462 | 9/2002 |
| WO | WO2010/110225 | 9/2010 |

* cited by examiner

Main
Start Motor
110
Secondary Function
112
θ_min(S,W)≤θ≤θ_max(S,W) ?
No
Yes
114
I > I_min(S,W) ?
Yes
No
116
Stop Motor
Good Clutch
118
I≥I_seat(S,W) ?
No
Yes
Find Slope
119
120
Slope = = Down ?
No
I≥I_e(S,W) ?
No
Yes
Yes
126
Stop Motor
Abnormal Clutch
122
I≥I_e(S,W) ?
No
Yes
Stop Motor
123
Good Clutch
End
Primary Function

ELECTRONIC CLUTCH FOR POWER TOOL

CROSS-REFERENCE TO RELATED APPLICATIONS

This application claims the benefit of U.S. Provisional Application No. 61/623,739, filed on Apr. 13, 2012. The entire disclosure of the above application is incorporated herein by reference.

FIELD

This application relates to power tools such as drills, drivers, and fastening tools, and electronic clutches for power tools.

BACKGROUND

Many power tools, such as drills, drivers, and fastening tools, have a mechanical clutch that interrupts power transmission to the output spindle when the output torque exceeds a threshold value of a maximum torque. Such a clutch is a purely mechanical device that breaks a mechanical connection in the transmission to prevent torque from being transmitted from the motor to the output spindle of the tool. The maximum torque threshold value may be user adjustable, often by a clutch collar that is attached to the tool between the tool and the tool holder or chuck. The user may rotate the clutch collar among a plurality of different positions for different maximum torque settings. The components of mechanical clutches tend to wear over time, and add excessive bulk and weight to a tool.

Some power tools additionally or alternatively include an electronic clutch. Such a clutch electronically senses the output torque (e.g., via a torque transducer) or infers the output torque (e.g., by sensing another parameter such as current drawn by the motor). When the electronic clutch determines that the sensed output torque exceeds a threshold value, it interrupts or reduces power transmission to the output, either mechanically (e.g., by actuating a solenoid to break a mechanical connection in the transmission) or electrically (e.g., by interrupting or reducing current delivered to the motor, and/or by actively braking the motor). Existing electronic clutches tend to be overly complex and/or inaccurate.

This section provides background information related to the present disclosure which is not necessarily prior art.

SUMMARY

This section provides a general summary of the disclosure, and is not a comprehensive disclosure of its full scope or all of its features.

In an aspect, a power tool for driving a fastener includes a housing coupleable to a power source; an output spindle coupled to a tool holder; a motor disposed in the housing and having an output shaft; a transmission transmitting torque from the motor output shaft to the output spindle; a switch for controlling delivery of power from the power source to the motor; and an electronic clutch configured to interrupt transmission of torque to the output spindle when a threshold torque value is exceeded. The electronic clutch includes a current sensing circuit that generates a sensed current signal that corresponds to the amount of current being delivered to the motor; a rotation sensing circuit that generates a sensed rotation signal that corresponds to at least one of an angular position, speed, or acceleration of the motor output shaft; and a controller coupled to the current sensing circuit and the rotation sensing circuit. The controller, in a first mode of operation, initiates a first protective action to interrupt transmission of torque to the output spindle when the sensed rotation signal indicates that the rotational speed of the motor is decreasing and the sensed current signal exceeds a first current threshold value.

Implementations of this aspect may include one or more of the following features. The power source may include a battery coupled to the housing. The motor may be a brushless motor. The switch may be a variable speed trigger. The variable speed trigger may be coupled to the controller and the controller may output a pulse width modulation (PWM) signal to the motor based upon how far the trigger is depressed. The rotation sensing circuit may include a rotation sensor, e.g., one or more Hall sensors in the motor. The current sensing circuit includes a current sensor, e.g., a shunt resistor in series with the motor. The first protective action may include one or more of interrupting power to the motor, reducing power to the motor, braking the motor, and/or actuating a mechanical clutch element. The controller may initiate the first protective action only if the controller has previously determined that the sensed current signal exceeds a second current threshold value that is different than the first current threshold value.

The controller may initiate a second protective action to interrupt transmission of torque to the output spindle when the controller determines that the trigger has been actuated a second time while continuing to drive the same fastener after the first protective action. The controller may initiate the second protective action when the sensed rotation signal indicates that the amount of time for a given amount of angular rotation of the motor output shaft is between a minimum threshold value and a maximum threshold value, and when the current signal indicates exceeds a third current threshold value that is less than the first current threshold value. The second protective action may include at least one of interrupting power to the motor, reducing power to the motor, braking the motor, and/or actuating a mechanical clutch element.

The power tool may include a clutch setting switch for changing a torque setting of the electronic clutch. The clutch setting switch may be in the form of a rotatable collar proximate the tool holder. A clutch setting circuit may generate a clutch setting signal that corresponds to a position of the clutch setting switch. The clutch setting circuit may include a membrane potentiometer and a pressure pin or stylus coupled to the clutch collar such that rotation of the clutch collar causes the stylus to move across the membrane potentiometer to change the resistance of the membrane potentiometer. The clutch setting switch may include a setting for a drill mode. When the clutch setting signal indicates that the clutch setting switch is in the drill mode, the controller deactivates the electronic clutch. The clutch setting switch may also include one or more settings for no-hub modes. When the clutch setting signal indicates that one or more of the no-hub modes has been selected, the controller may limit the PWM duty cycle to be less than a maximum duty cycle (e.g., approximately 50% of the maximum duty cycle).

The transmission may comprise a multi-speed transmission, where the speed setting can be changed by a selector switch on an exterior of the housing. A speed selector circuit may generate a speed selector signal that corresponds to a position of the selector switch. The speed selector circuit may include a membrane potentiometer and a pressure pin or stylus coupled to the speed selector switch such that movement of the speed selector switch causes the stylus to move across the membrane potentiometer to change the resistance of the membrane potentiometer.

The electronic clutch may include a memory with a look-up table that includes one or more of: (1) a plurality of first current threshold values; (2) a plurality of second current threshold values; (3) a plurality of third current threshold values; (4) a plurality of minimum threshold values and/or (5) a plurality of maximum threshold values. In the look-up table, each combination of clutch threshold values may correspond to a combination of one or more of: (a) a clutch setting signal; (b) a speed selector signal; and (c) a PWM duty cycle. The controller may use the look-up table to select one or more of the clutch threshold values based upon one or more of: (a) the clutch setting signal; (b) the speed selector signal; and (c) the PWM duty cycle In another aspect, a power tool for driving a fastener includes a housing coupleable to a power source; an output spindle coupled to a tool holder; a motor disposed in the housing and having an output shaft; a transmission transmitting torque from the motor output shaft to the output spindle; a switch for controlling delivery of power from the power source to the motor; and a clutch setting switch that is moveable relative to the housing to select a clutch setting of the power tool. The clutch setting switch includes an electronic clutch setting sensor that generates a signal corresponding the clutch setting. The clutch setting sensor includes a membrane potentiometer that is stationary relative to the housing, and a pressure pin that moves with the clutch collar along the membrane potentiometer to change the resistance of the membrane potentiometer.

In another aspect, a power tool for driving a fastener includes a housing coupleable to a power source; an output spindle coupled to a tool holder; a motor disposed in the housing and having an output shaft; a multi-speed transmission transmitting torque from the motor output shaft to the output spindle; a switch for controlling delivery of power from the power source to the motor; and a speed selection switch that is moveable relative to the housing to select a speed setting of the multi-speed transmission. The speed selection switch includes an electronic speed setting sensor that generates a signal corresponding the speed setting. The speed setting sensor includes a membrane potentiometer that is stationary relative to the housing, and a pressure pin that moves with the speed selector switch along the membrane potentiometer to change the resistance of the membrane potentiometer.

Advantages may include one or more of the following. The electronic clutch is very accurate while not requiring a great deal of processing power. The electronic clutch provides the user with a reliable clutch, comparable in performance to a mechanical clutch, without the added length, girth, or weight, in a compact and economical package that is inexpensive. These and other advantages and features will be apparent from the description and the drawings.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1A:
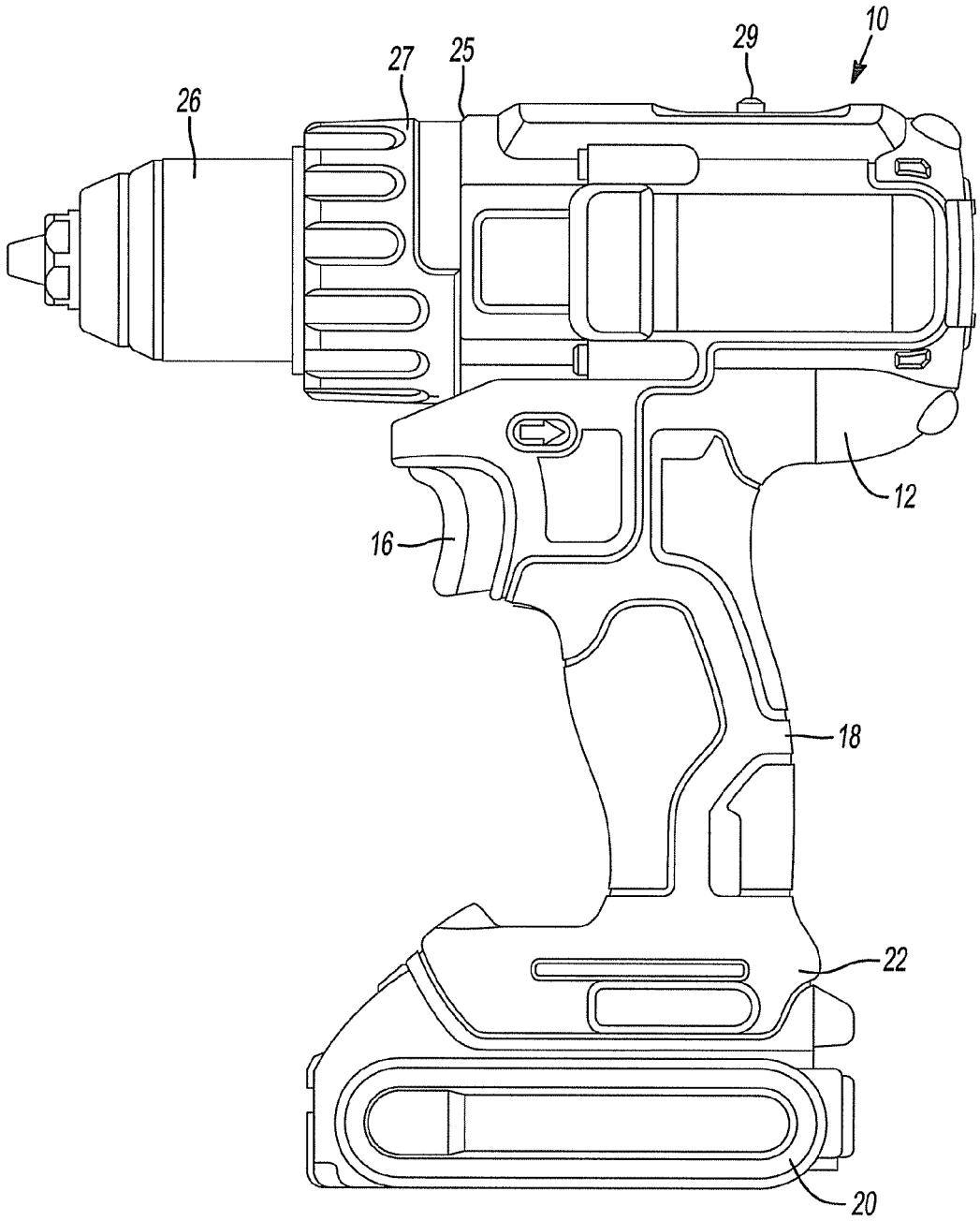
FIG. 1A is an illustration of an embodiment of a power tool that includes an embodiment of an electronic clutch
Figure 5:
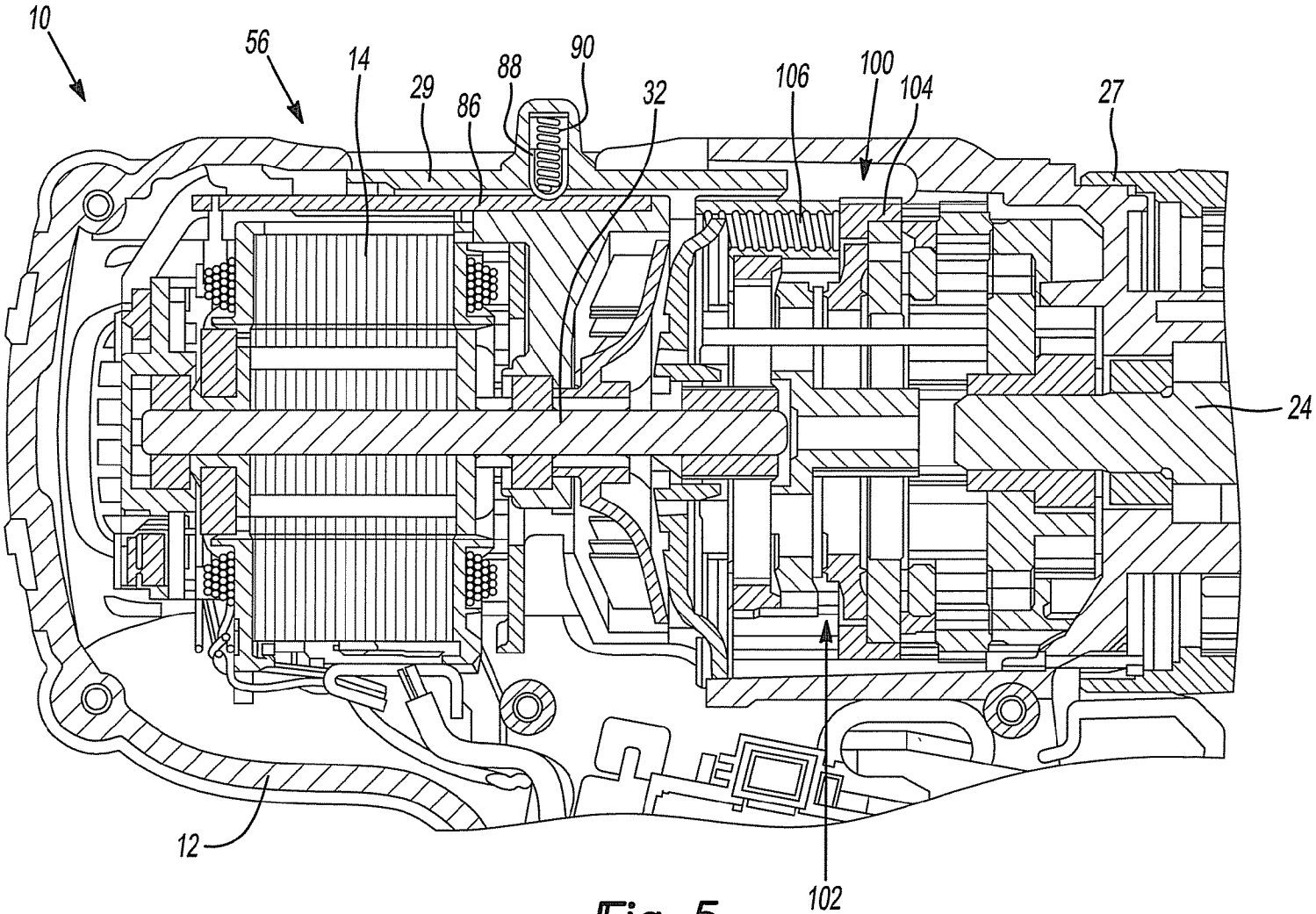
FIG. 5 is a partial cross-sectional view of the tool of FIG. 1, illustrating the speed selector switch.
Figure 6:
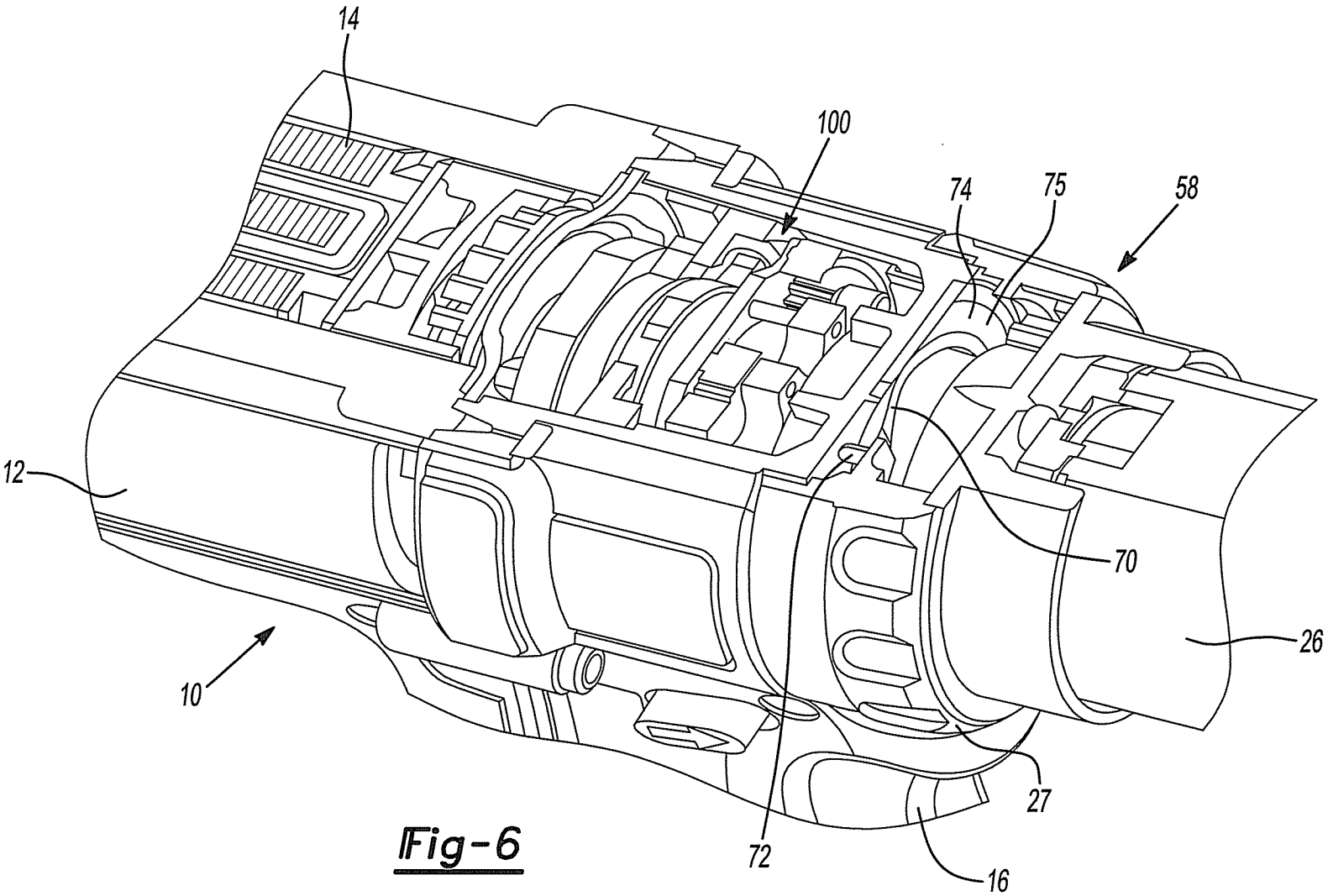
FIGS. 6 and 7 are partial cross-sectional views of the tool of FIG. 1, illustrating the clutch setting collar and clutch setting sensor.

Referring to FIGS. 1A, 5, and 6, a power tool, e.g., a power drill/driver 10, has a housing 12, a motor 14 contained in the housing 12, and a switch 16 (e.g., a variable speed trigger) coupled to the housing for selectively actuating and controlling the speed of the motor 14 (e.g., by controlling a pulse width modulation (PWM) signal delivered to the motor 14). In one embodiment, the motor is a brushless or electronically commutated motor, although the motor may be another type of brushed DC or universal motor. Extending downward from the housing 12 is a handle 18 with a battery 20 or other source of power (e.g., alternating current cord or compressed air source) coupled to a distal end 22 of the handle 18. An output spindle 24 is proximate a front end 25 of the housing 12 and is coupled to a tool holder 26 for holding a power tool accessory, e.g., a tool bit such as a drill bit or a screwdriver bit. In the illustrated example of FIG. 1A, the tool holder 26 is a keyless chuck, although it should be understood that the tool holder can have other configurations such as a quick release tool holder, a hex tool holder, or a keyed chuck. An output shaft 32 extends from the motor 14 to a transmission 100 that transmits power from the output shaft 32 to the output spindle 24 and to the tool holder 26. The power tool further includes a clutch setting switch or collar 27 that is used to adjust a clutch setting of the electronic clutch described below. The power tool may also include a speed selector switch 29 for selecting the speed reduction setting of the transmission.

Figure 1B:
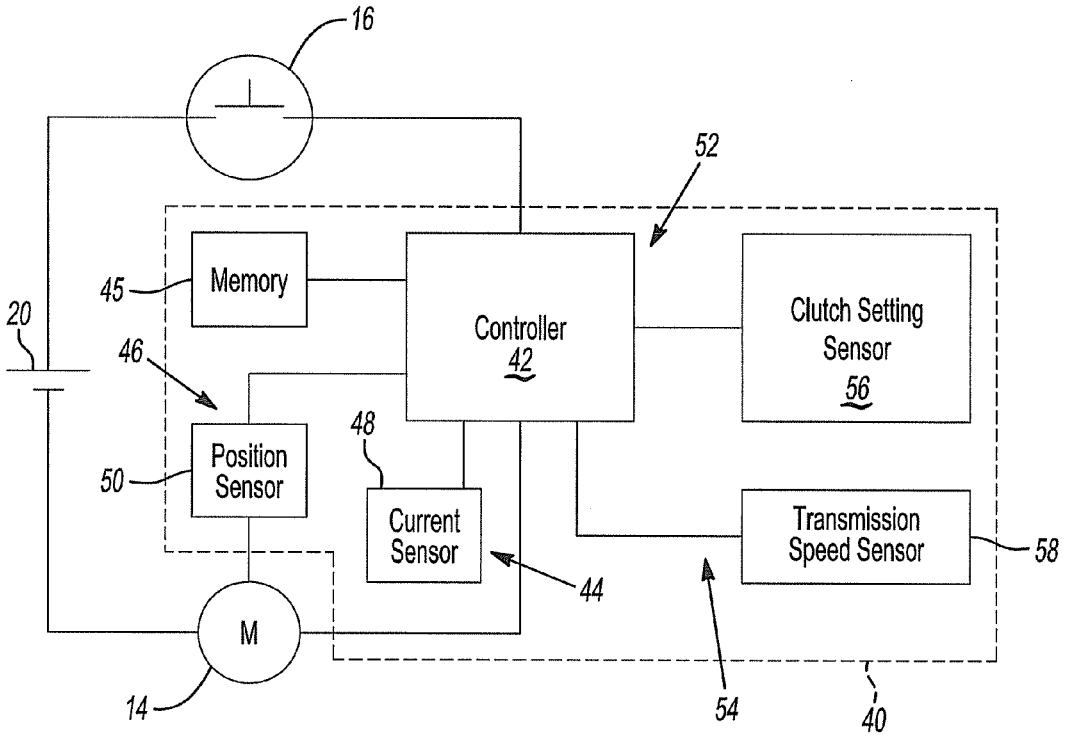
FIG. 1B is a schematic diagram of the electronic clutch of the tool of FIG. 1.

Referring to FIG. 1B, the power tool 10 has an electronic clutch 40 that includes a controller, 42, a current sensing circuit 44, and a position sensing circuit 46. The current sensing circuit 44 includes a current sensor 48 (e.g., a shunt resistor) that senses the amount of current being delivered to the motor and provides a current sensing signal corresponding to the sensed current to the controller 42. The rotation sensing circuit 46 includes one or more rotation sensors 50 that sense changes in the angular position of the motor output shaft and provides a signal corresponding to the angular rotation, speed, and/or acceleration of the motor to the controller.

In one embodiment, the controller 42 is further defined as a microcontroller. In other embodiments, controller refer to, be part of, or include an electronic circuit, an Application Specific Integrated Circuit (ASIC), a processor (shared, dedicated, or group) and/or memory (shared, dedicated, or group) that execute one or more software or firmware programs, a combinational logic circuit, and/or other suitable components that provide the described functionality.

In one embodiment, the position sensors can be the Hall sensors that are already part of a brushless motor. For example, the power tool may include a three-phase brushless motor, where the rotor includes a four pole magnet, and there are three Hall sensors positioned at 120° intervals around the circumference of the rotor. As the rotor rotates, each Hall sensor senses when one of the poles of the four pole magnet passes over the Hall sensor. Thus, the Hall sensors can sense each time the rotor, and thus the output shaft, rotates by an increment of 60°.

In one embodiment, the rotation sensing circuit can use the signals from the Hall sensors to infer or calculate the amount of angular rotation, speed, and/or acceleration of the rotor. For example, the rotation sensing circuit includes a clock or counter that counts the amount of time or the number of counts between each 60° rotation of the rotor. The controller can use this information to calculate or infer the amount of angular rotation, speed, and/or acceleration of the motor.

Figure 7:
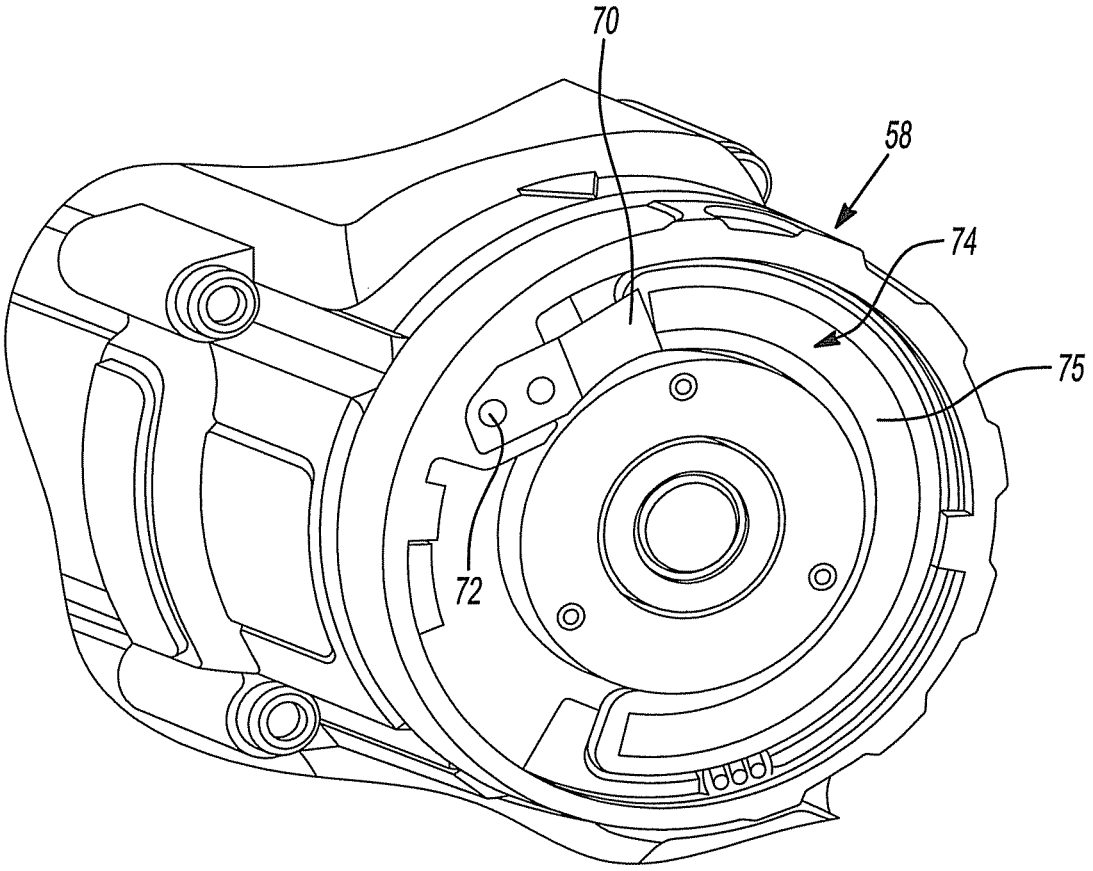

The electronic clutch 40 may also include a clutch setting circuit 52. The clutch setting circuit 52 includes a clutch setting sensor that senses the setting set of the clutch setting collar 27 and that provides a signal corresponding to that clutch setting to the controller. In one embodiment, as illustrated in FIGS. 6 and 7, the clutch collar 27 is coupled to a pressure pin or stylus in the form of a spring 70 with a stamped feature where the spring 70 biases the stamped feature against a clutch setting sensor in the form of a membrane potentiometer 74. The spring 70 is affixed to the clutch collar 27 by a heat stake 72 so that the spring 70 and clutch collar 27 rotate together with the clutch collar, while the membrane potentiometer 74 remains stationary. A membrane potentiometer comprises a flat, semi-conductive strip or membrane 75 whose resistance changes when pressure is applied in different locations along the membrane. The membrane can be composed of a variety of materials, such as PET, foil, FR4, and/or Kapton. The membrane potentiometer 74 is in the form of a semi-circle, so that as the stylus moves along the membrane, the resistance changes. Thus, by sensing the voltage at the output of the membrane potentiometer, the clutch setting circuit 52 can sense the position or clutch setting of the clutch collar 27. In other embodiments, the clutch collar 27 may be coupled to another type of potentiometer or variable resistor, to another type of sensor such as one or more Hall effect sensors, or using a switch, or to another type of switch such as a multi-pole switch, to sense position of the clutch collar 27.

The clutch setting switch may also include a setting for a drill mode. When the clutch setting signal indicates that the clutch setting switch is in the drill mode, the controller deactivates the electronic clutch. The clutch setting switch may also include one or more settings for no-hub modes. When the clutch setting signal indicates that one or more of the no-hub modes has been selected, the controller may limit the PWM duty cycle to be less than a maximum duty cycle (e.g., approximately 50% of the maximum duty cycle)

Referring to FIG. 5, in an embodiment, the transmission 100 comprises a multi-speed transmission having a plurality of gears and settings that allow the speed reduction through the transmission to be changed, in a manner well understood to one of ordinary skill in the art. In the illustrated embodiment, the transmission 100 comprises a multi-stage planetary gear set 102, with each stage having an input sun gear, a plurality of planet gears meshed with the sun gears and pinned to a rotatable planet carrier, and a ring gear meshed with and surrounding the planet gears. For each stage, if a ring gear is rotationally fixed relative to the housing, the planet gears orbit the sun gear when the sun gear rotates, transferring power at a reduced speed to their planet carrier, thus causing a speed reduction through that stage. If a ring gear is allowed to rotate relative to the housing, then the sun gear causes the planet carrier to rotate at the same speed as the sun gear, causing no speed reduction through that stage. By varying which one or ones of the stages have the ring gears are fixed against rotation, one can control the total amount of speed reduction through the transmission, and thus adjust the speed setting of the transmission (e.g., among high, medium, and low). In the illustrated embodiment, this adjustment of the speed setting is achieved via a shift ring 104 that surrounds the ring gears and that is shiftable along the axis of the output shaft to lock different stages of the ring gears against rotation. The speed selector switch 29 is coupled to the shift ring 104 by spring biased pins so that axial movement of the speed selector switch 29 causes the axial movement of the shift ring 104. Further details regarding an exemplary multi-speed transmission is described in U.S. Pat. No. 7,452,304 which is incorporated by reference in its entirety. It should be understood that other types of multi-speed transmissions and other mechanisms for shifting the transmission among the speeds is within the scope of this application.

The electronic clutch includes a speed selector circuit 54 that senses the position of the speed selector switch 29 to determine which speed setting has been selected by the user. In one embodiment, the speed selector switch 29 is coupled to a pressure pin or stylus 88 that is biased downwardly by a spring 90 against a speed setting sensor in the form of a linear membrane potentiometer 86. The stylus 88 and spring 90 move linearly with the speed selector switch 29, while the membrane potentiometer 86 remains stationary, such that the resistance of the membrane potentiometer 86 changes with different speed settings. Thus, by sensing the voltage drop across the membrane potentiometer 86, the speed selector circuit 52 can sense the position or speed setting of the speed selector switch 29, and provides a signal corresponding to the speed setting to the controller 42. In other embodiments, the speed selector switch may be coupled to another type of potentiometer or variable resistor, to another type of sensor such as one or more Hall effect sensors, or to another type of switch, such as a multi-pole switch, to sense position of the speed selector switch.

Figure 2:
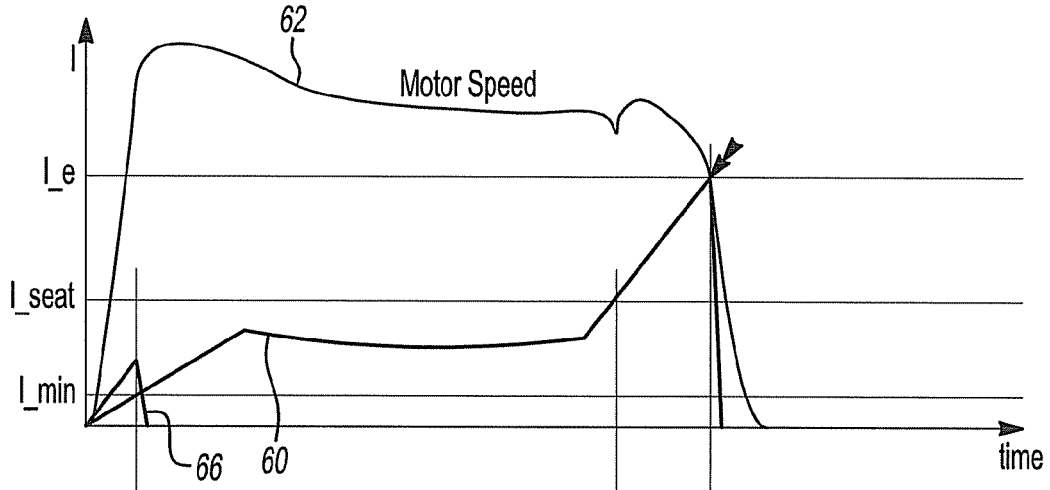
FIGS. 2 and 3 are graphs illustrating operation of the electronic clutch of the tool of FIG. 1.

Referring to FIG. 2, in a first mode of operation, the electronic clutch determines when the desired torque or clutch setting has been reached or exceeded based upon satisfaction of the following conditions: (1) the current to the motor (indicated by line 60 in FIG. 2) has exceeded a first current threshold value for when the fastener should be seated (I_seat); (2) the motor speed (indicated by line 62 in FIG. 2) has started to decrease (which can be determined by sensing the change in angular speed over time); and (3) while the angular speed is decreasing, the current being drawn by the motor is greater than a maximum threshold value (I_e) that is greater than I_seat. Satisfaction of these conditions indicates that the torque has reached or exceeded its desired setting. If these conditions are satisfied, the controller initiates a first protective action to interrupt torque transmission to the output spindle e.g., by interrupting power to the motor, reducing power to the motor, and/or actively braking the motor (e.g., by shorting across the windings of the motor).

Figure 8:
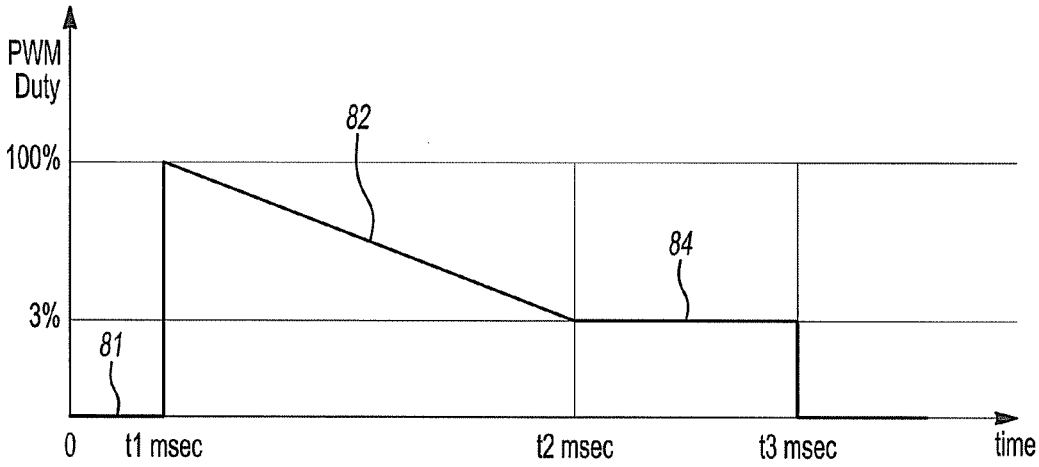
FIG. 8 is a diagram illustrating an example soft braking technique for the motor.

In one embodiment, a soft braking scheme is employed as the protective operation as shown in FIG. 8. When conditions triggering the protective operation have been met, power to the motor is cut off and the motor is permitted to coast 81 for a predefined period of time (e.g., 10-30 milliseconds). The PWM signal is then reapplied to the motor as indicated at 82. The signal is initially applied at a 100% duty cycle and then gradually decreased to a much lower duty cycle (e.g., 3%). The PWM signal continues to be applied to the motor for a period of time as indicated at 84 before being set of zero (i.e., interrupting power to the motor). It is envisioned that the signal applied to the motor during braking may be decreased linearly, exponentially, or in accordance with some other function from 100%. In other embodiments, the PWM signal may also be ramped up linearly, exponentially or in accordance with some other function from zero to 100%. Other variants for the soft braking of the motor are also contemplated by this disclosure. Moreover, other types of protective operations fall with the scope of this disclosure.

The drill/driver 10 may be configured to provide a user perceptible output which indicates the occurrence of the protective operation. In one example embodiment, the user is provided with haptic feedback to indicate the occurrence of the protective operation. By driving the motor back and forth quickly between clockwise and counter-clockwise, the motor can be used to generate a vibration of the housing which is perceptible to the tool operator. The magnitude of a vibration is dictated by a ratio of on time to off time; whereas, the frequency of a vibration is dictated by the time span between vibrations. The duty cycle of the signal delivered to the motor is set (e.g., 10%) so that the signal does not cause the motor to rotate. In the case of a conventional H-bridge motor drive circuit, the field effect transistors in the bridge circuit are selectively open and closed to change the current flow direction and therefore the rotational direction of the motor.

In another example embodiment, the haptic feedback is generated using a different type of pulsing scheme. Rather than waiting to reach the maximum threshold value, the control algorithm can begin providing haptic feedback prior to reaching the maximum threshold value. The feedback is triggered when the torque (as indicated for example by the monitored current) reaches a trip current I_t which is set at a value lower than the maximum threshold current. The value of the trip current may be defined as a function of the trigger position, transmission speed and/or clutch setting in a manner similar to the other threshold values.

Figure 9:
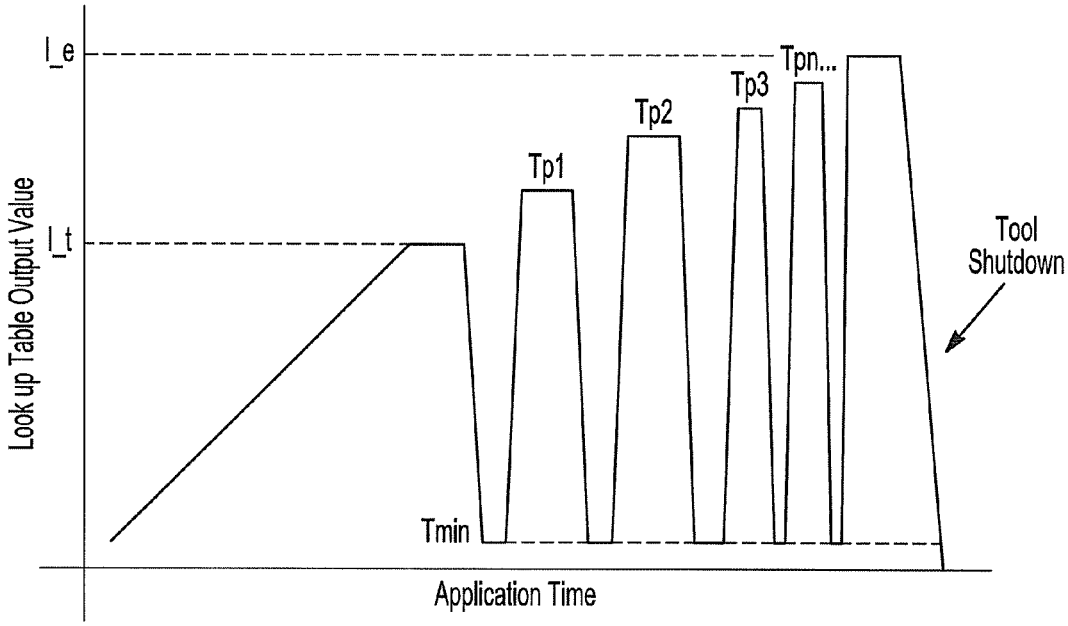
FIG. 9 is a diagram illustrating a motor pulsing scheme which provides haptic feedback to the tool operator.

During tool operation, the torque output may ramp up as shown in FIG. 9. When the current exceeds the trip current I_t, the controller will begin to pulse the motor as shown. In an exemplary embodiment, the motor is driven by the pulses only in the same direction as the motor was being driven when is reached the trip current. As the motor is energized and then de-energized by the pulses, a vibration of the housing is generated, such that the vibration is perceptible to the tool operator is generated. Pulses (TP1, TP2, TP3 . . . TPn) gradually increase in amplitude until the current exceeds the maximum threshold current I_e and the tool is shutdown.

During pulsing, the tool operator can stop the drill by releasing the trigger. As the pulsed amplitude increases, the modulated frequency between pulses will also change to further improve precise control of seating the fastener. The pulse frequency can be set as a function of trigger position, transmission speed and/or clutch setting and can change as current approaches the maximum threshold current. The off time between pulses is preferably equal to a zero output power so it does not drive the fastener during the short duration. It may be desirable, however, to increase the off time during the application to match the slop increase until tool shutdown is reached. This type of operation enables the user to achieve an installation torque that is below the torque which corresponds to the maximum threshold current. Other schemes for vibrating the tool are also contemplated by this disclosure. Alternatively or additionally, other types of feedback (e.g., visual or audible) may be used to indicate the occurrence of the protective operation.

Figure 3:
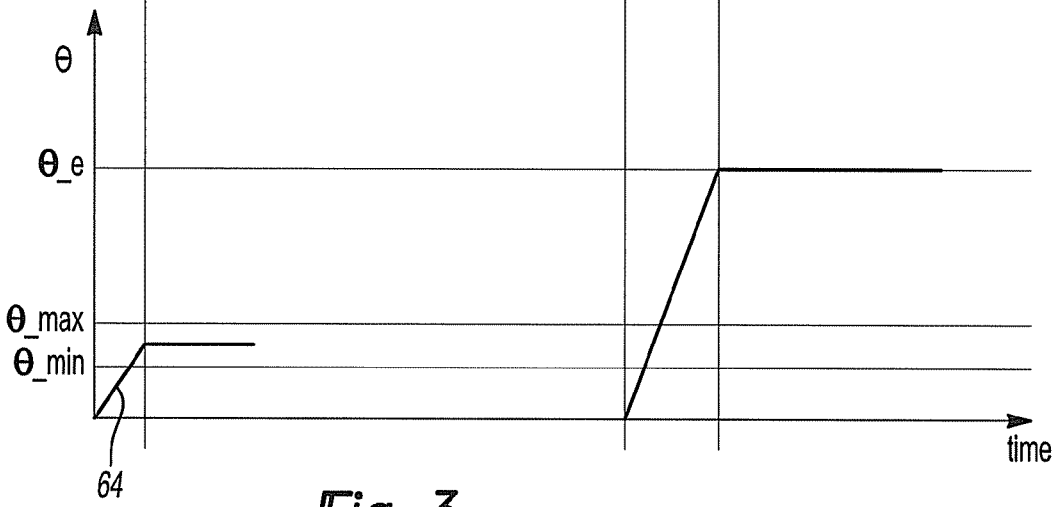

Referring to FIGS. 2 and 3, in a second mode of operation, the electronic clutch prevents torque from being transmitted to the output spindle if the user actuates the trigger a subsequent time after the first protective operation in an attempt to continue driving the same fastener. In the second mode of operation, when this event happens, the change in angular position of the motor output shaft over time (indicated by line 64 in FIG. 3) tends to be very small while the current drawn by the motor (indicated by line 66 in FIG. 2) tends to quickly spike above a minimum value (I_min). If the amount of time or the number of counts that the motor shaft takes to rotate by 60° is greater than a minimum threshold value (θ_min) and less than a maximum threshold value (θ_max), and the sensed current is above I_min, the controller initiates a second protective operation to interrupt torque transmission to the output spindle, e.g., interrupting power to the motor, reducing power to the motor, and/or actively braking the motor.

Figure 4:
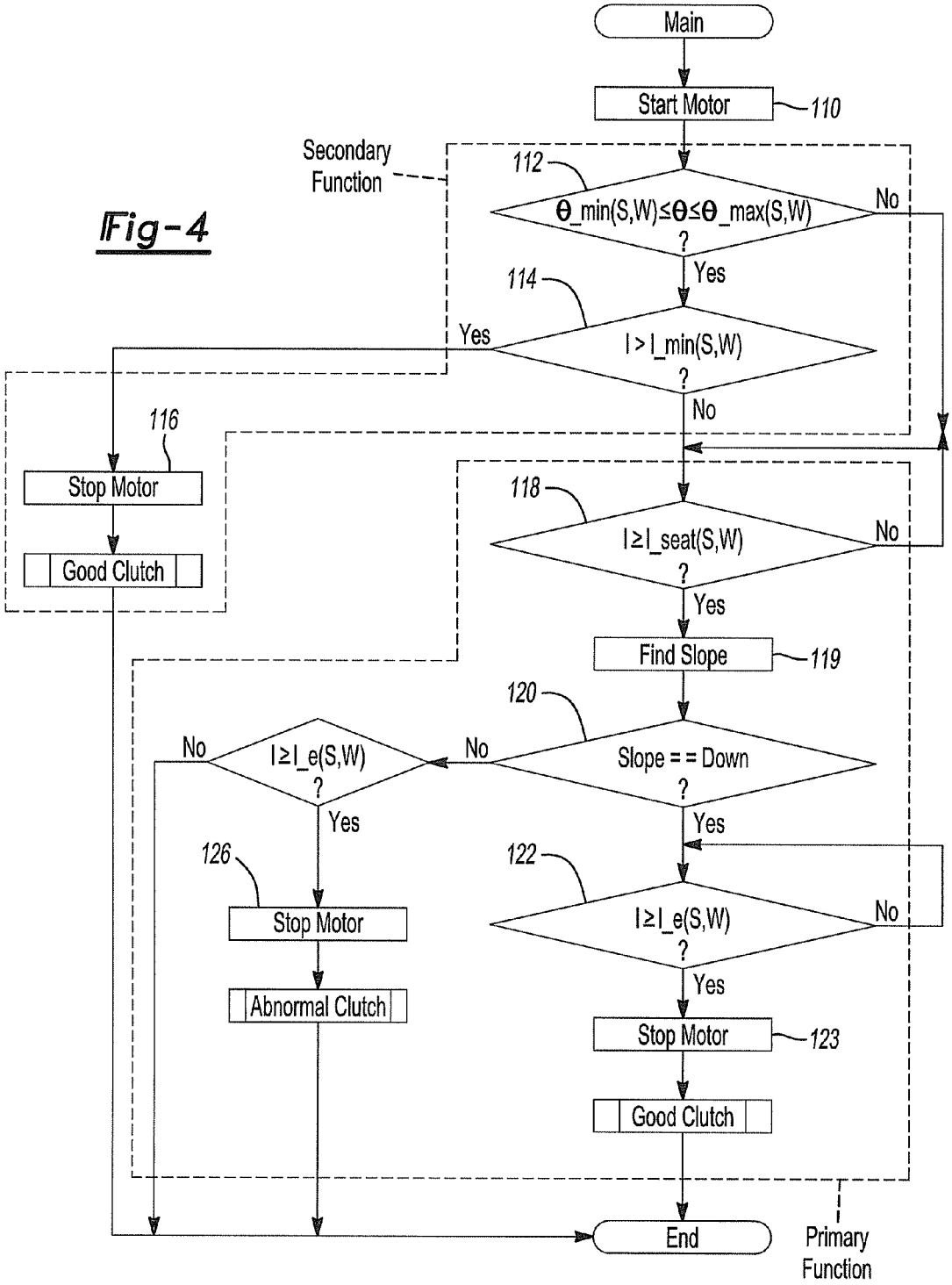
FIG. 4 is a flow chart illustrating operation of the electronic clutch of the tool of FIG. 1.

The flow chart in FIG. 4 illustrates a method or algorithm implemented by the electronic clutch and controller in the first and second modes of operation. At step 110, power is delivered to start the motor. The conditions for the secondary function (or second mode of operation) are then checked first. At step 112, the algorithm determines whether the number of counts for a change in angular position 8 of the rotor is between θ_min and θ_max. If so, then at step 114, the algorithm determines whether the sensed current I is greater than I_min. If so, then at step 116, the controller initiates a protective operation, e.g., by interrupting power to the motor, reducing power to the motor, actively braking the motor, and/or actuating a mechanical clutch. If one or both of the conditions for the secondary function is not satisfied, the algorithm proceeds to evaluate the primary function (or first mode of operation).

At step 118, the controller determines whether the sensed current I is greater than the threshold value for when the fastener should be seated (I_seat). Once this threshold has been exceeded, at step 119, the controller determines the slope of the motor speed curve (i.e., whether the motor speed is increasing or decreasing). This can be done by storing in a memory sequential values for the amount of time or the number of counts for each 60° rotation of the motor shaft (determined, e.g., by using a clock, timer, or counter to determine the amount of time the rotor takes to rotate by 60° as sensed by the Hall sensors in the motor). If the amount of time (or the number of counts) for each 60° rotation is increasing, this indicates that the motor speed is decreasing. Conversely, if the amount of time (or the number of counts) for each 60° rotation is decreasing, this indicates that the motor speed is increasing. If, at step 120, it is determined that the speed is decreasing, then at step 122, the controller determines whether the sensed current I is greater than the maximum threshold current I_e. If each of these conditions are satisfied, then at step 123 the controller initiates a protective operation, e.g., interrupts power to the motor, reduces power to the motor, actively brakes the motor, and/or actuates a mechanical clutch.

The method or algorithm may also result in an abnormal clutch condition. If, at step 120 it is determined that the slope of the speed curve is not decreasing (i.e., the rotor is not decreasing in speed), then at step 124, the sensed current I is compared to the maximum current I_e. If the sensed current I is greater than the maximum current I_e, then at step 126 the controller interrupts the current to the motor, reduces power to the motor, and/or actively brakes the motor. This is considered to be an abnormal trip of the electronic clutch.

The values of the threshold values of θ_min, θ_max, I_min, I_seat, and I_e can be varied depending on one or more of the clutch setting (S), the selected speed of the transmission (W), and the duty cycle of the PWM signal (which corresponds to the amount of trigger travel). The electronic clutch may include a memory 45 coupled to the controller. The memory may include a look-up table that correlates combinations of values for the clutch setting, the speed setting, and the PWM duty cycle, to the threshold values of θ_min, θ_max, I_min, I_seat, and I_e. The controller may use the look-up table to select one or more of the threshold values of θ_min, θ_max, I_min, I_seat, and I_e, based upon the selected clutch setting, the selected speed setting, and the amount of trigger travel or PWM duty cycle. For example, for clutch setting 1, speed setting 1, and a PWM duty cycle of 75-100% of maximum, the threshold values of θ_min, θ_max, I_min, I_seat, and I_e may be 1170 counts/60° rotation, 2343 counts/60° rotation, 2.0 amps, 3.1 amps, and 5.1 amps, respectively. In another examples, for clutch setting 3, speed setting 2, and a PWM duty cycle of 25-50% of maximum, the threshold values of θ_min, θ_max, I_min, I_seat, and I_e may be 1170 counts/60° rotation, 2343 counts/60° rotation, 4.0 amps, 6.7 amps, and 8.7 amps, respectively. In general, the threshold values increases with an increase in motor speed (caused by either an increase in duty cycle or a change in gear setting) as well as with an increase in the desired clutch setting. It should be understood that the threshold values in the look-up table may be derived empirically and will vary based on many factors such as the type of power tool, the size of the motor, the voltage of the battery, etc. In addition, it should be understood that the look-up table can include fewer parameters used to determine the threshold values (e.g., only clutch setting, but not speed setting or PWM duty), and/or only some of the threshold values of θ_min, θ_max, I_min, I_seat, and I_e). In addition, the look-up table may be divided into multiple look-up tables for different modes of operation.

In another embodiment, the clutch setting switch may also include one or more settings for a "no-hub mode." In this mode, the tool is used to apply a precise amount of torque for applications related to plumbing, such as tightening a clamping band on a no-hub pipe coupling (known as no-hub bands). In one such embodiment, a user selects between a first, low torque setting and a second, high torque setting. When the clutch setting signal indicates that one or more of the no-hub modes has been selected, the controller, in addition to looking up the threshold values θ_min, θ_max, I_min, I_seat, and I_e, may also limit the PWM duty cycle to be less than a maximum duty cycle (e.g., approximately 50% of the maximum duty cycle). This is done in order to obtain a more accurate result when clamping no-hub bands.

In some embodiments, the techniques described herein may be implemented by one or more computer programs executed by one or more processors (e.g., controller 42) residing in the drill/driver 10. The computer programs include processor-executable instructions that are stored on a non-transitory tangible computer readable medium. The computer programs may also include stored data. Non-limiting examples of the non-transitory tangible computer readable medium are nonvolatile memory, magnetic storage, and optical storage.

Some portions of the above description present the techniques described herein in terms of algorithms and symbolic representations of operations on information. These algorithmic descriptions and representations are the means used by those skilled in the data processing arts to most effectively convey the substance of their work to others skilled in the art. These operations, while described functionally or logically, are understood to be implemented by computer programs. Furthermore, it has also proven convenient at times to refer to these arrangements of operations as modules or by functional names, without loss of generality.

Unless specifically stated otherwise as apparent from the above discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system memories or registers or other such information storage, transmission or display devices.

Certain aspects of the described techniques include process steps and instructions described herein in the form of an algorithm. It should be noted that the described process steps and instructions could be embodied in software, firmware or hardware.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method of controlling operation of a power tool having an electric motor drivably coupled to an output spindle, comprising:

receiving, by a controller residing in the power tool, an input indicative of a clutch setting for an electronic clutch, the clutch setting being selectable from a plurality of driver modes and each of the plurality of driver modes specifies a different value of torque at which to interrupt transmission of torque to the output spindle;

setting, by the controller, the value of a maximum current threshold in accordance with the selected one of the plurality of driver modes;

determining, by the controller, rotational speed of the electric motor;

determining, by the controller, an amount of current being delivered to the electric motor;

comparing, by the controller, the amount of current being delivered to the electric motor to the maximum current threshold; and interrupting transmission of torque to the output spindle when the amount of current being delivered to the electric motor exceeds the maximum current threshold and the rotational speed of the electric motor is decreasing.

2. The method of claim 1 further comprising receiving, by the controller, an input indicative of a drill mode as a clutch setting for the electronic clutch; and disregarding, by the controller, torque applied to the output spindle when the clutch setting is in drill mode.

3. The method of claim 1 wherein receiving an input further comprises capturing the input using a collar integrated into a housing of the power tool and moveable relative thereto, wherein the collar is interfaced with a membrane potentiometer that outputs a signal indicative of a clutch setting to the controller.

4. The method of claim 1 wherein determining rotational speed further comprises counting number of revolutions of the electric motor during a given time period using a Hall effect sensor.

5. The method of claim 1 further comprising receiving, by the controller, a secondary input indicative of a speed setting for a transmission; and setting, by the controller, the value of a maximum current threshold in accordance with the speed setting and the selected one of the plurality of driver modes.

6. The method of claim 1 further comprising receiving, by the controller, an indicator for position of a trigger switch, where the trigger switch operates to control quantity of current delivered to the electric motor; and setting, by the controller, the value of a maximum current threshold in accordance with the indicator of trigger position and the selected one of the plurality of driver modes.

7. The method of claim 1 wherein comparing the amount of current being delivered to the electric motor to the maximum current threshold further comprises:

comparing the amount of current being delivered to the electric motor to an intermediate current threshold, where the value of the intermediate current threshold is less than the maximum current threshold;

determining whether the rotational speed of the electric motor is decreasing, the determination being performed when the amount of current being delivered to the electric motor exceeds the intermediate current threshold;

comparing the amount of current being delivered to the electric motor to the maximum current threshold, the comparison being performed when the amount of current being delivered to the electric motor exceeds the first current threshold and the rotational speed of the electric motor is decreasing; and interrupting transmission of torque to the output spindle when the amount of current being delivered to the electric motor exceeds the maximum current threshold.

8. The method of claim 1 wherein interrupting transmission of torque further comprises at least one of interrupting electrical power to the electric motor, reducing electrical power to the electric motor, braking the electric motor and actuating a mechanical clutch disposed between the electrical motor and the output spindle.

9. A method of controlling operation of a power tool having an electric motor drivably coupled to an output spindle, comprising:

receiving, by a controller residing in the power tool, an input indicative of a clutch setting for an electronic clutch, the clutch setting being selectable from a plurality of driver modes and each of the plurality of driver modes specifies a different value of torque at which to interrupt transmission of torque to the output spindle;

determining, by the controller, an amount of current being delivered to the electric motor;

determining, by the controller, rotational speed of the electric motor; and monitoring, by the controller, torque applied to the output spindle when the clutch setting is in a select one of the plurality of driver modes, wherein monitoring torque further includes comparing the amount of current being delivered to the electric motor to a first current threshold;

determining whether the rotational speed of the electric motor is decreasing, the determination being performed when the amount of current being delivered to the electric motor exceeds the first current threshold;

comparing the amount of current being delivered to the electric motor to a second current threshold, the comparison being performed when the amount of current being delivered to the electric motor exceeds the first current threshold and the rotational speed of the electric motor is decreasing, where the value of the second current threshold is larger than the first current threshold; and interrupting transmission of torque to the output spindle without the use of a mechanical clutch when the amount of current being delivered to the electric motor exceeds the second current threshold.

10. The method of claim 9 further comprising receiving, by the controller, an input indicative of a drill mode as a clutch setting for the electronic clutch; and disregarding, by the controller, torque applied to the output spindle when the clutch setting is in drill mode.

11. The method of claim 9 wherein receiving an input further comprises capturing the input using a collar integrated into a housing of the power tool and moveable relative thereto, wherein the collar is interfaced with a membrane potentiometer that outputs a signal indicative of a clutch setting to the controller.

12. The method of claim 9 wherein determining rotational speed further comprises counting number of revolutions of the electric motor during a given time period using a Hall effect sensor.

13. The method of claim 9 further comprising receiving, by the controller, a secondary input indicative of a speed setting for a transmission; and setting, by the controller, the value of a maximum current threshold in accordance with the speed setting and the selected one of the plurality of driver modes.

14. The method of claim 9 further comprising receiving, by the controller, an indicator for position of a trigger switch, where the trigger switch operates to control quantity of current delivered to the electric motor; and setting, by the controller, the value of a maximum current threshold in accordance with the indicator of trigger position and the selected one of the plurality of driver modes.

15. The method of claim 9 wherein interrupting transmission of torque further comprises at least one of interrupting electrical power to the electric motor, reducing electrical power to the electric motor, braking the electric motor and actuating a mechanical clutch disposed between the electrical motor and the output spindle.

16. A method of controlling operation of a power tool having an electric motor drivably coupled to an output spindle, comprising:

determining, by a controller residing in the power tool, whether a switch has been activated to deliver power to the electric motor;

determining, by the controller, rotational speed of the electric motor;

determining, by the controller, an amount of current being delivered to the electric motor;

comparing, by the controller, the amount of current being delivered to the electric motor to a maximum current threshold;

interrupting transmission of torque to the output spindle when the amount of current being delivered to the electric motor exceeds the maximum current threshold and the rotational speed of the electric motor is decreasing;

determining, by the controller, whether the switch has been activated within a predetermined time period after interrupting transmission of torque to the output spindle; and interrupting transmission of torque to the output spindle when the switch has been activated within a predetermined time period after interrupting transmission of torque to the output spindle and the amount of current being delivered to the electric motor exceeds a second current threshold value that is less than the maximum current threshold.

17. The method of claim 16 wherein transmission of torque to the output shaft is interrupted only upon the controller further determining that an amount of time for an predetermined amount of angular rotation of a motor output shaft is between a minimum threshold value and a maximum threshold value.

18. The method of claim 16 further comprising receiving, by the controller, an input indicative of a clutch setting for an electronic clutch, the clutch setting being selectable from a drill mode and a plurality of driver modes, where each of the plurality of driver modes specifies a different value of torque at which to interrupt transmission of torque to the output spindle; and setting, by the controller, the value of the maximum threshold value in accordance with the selected one of the plurality of driver modes.

19. The method of claim 16 further comprising receiving, by the controller, an input indicative of a drill mode as a clutch setting for the electronic clutch; and disregarding, by the controller, torque applied to the output spindle when the clutch setting is in drill mode.

20. The method of claim 16 wherein comparing the amount of current being delivered to the electric motor to the maximum current threshold further comprises:

comparing the amount of current being delivered to the electric motor to an intermediate current threshold, where the value of the intermediate current threshold is less than the maximum current threshold;

determining whether the rotational speed of the electric motor is decreasing, the determination being performed when the amount of current being delivered to the electric motor exceeds the intermediate current threshold;

comparing the amount of current being delivered to the electric motor to the maximum current threshold, the comparison being performed when the amount of current being delivered to the electric motor exceeds the first current threshold and the rotational speed of the electric motor is decreasing; and interrupting transmission of torque to the output spindle when the amount of current being delivered to the electric motor exceeds the maximum current threshold.

* * * * *